US011443729B2

(12) United States Patent
Bastyr et al.

(10) Patent No.: US 11,443,729 B2
(45) Date of Patent: Sep. 13, 2022

(54) SYSTEM AND METHOD FOR STEADY STATE VEHICLE SOUND SYNTHESIS

(71) Applicant: HARMAN INTERNATIONAL INDUSTRIES, INCORPORATED, Stamford, CT (US)

(72) Inventors: Kevin J Bastyr, Franklin, MI (US); Divya Sishtla Venkata, Novi, MI (US); David Paul Trumpy, Novi, MI (US); Santosh Lakshmikanth Adari, Farmington, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 17/057,962

(22) PCT Filed: May 31, 2018

(86) PCT No.: PCT/US2018/035414
§ 371 (c)(1),
(2) Date: Nov. 23, 2020

(87) PCT Pub. No.: WO2019/231452
PCT Pub. Date: Dec. 5, 2019

(65) Prior Publication Data

US 2021/0201885 A1 Jul. 1, 2021

(51) Int. Cl.
*G10K 15/02* (2006.01)
*G10K 11/178* (2006.01)
(Continued)

(52) U.S. Cl.
CPC ..... *G10K 15/02* (2013.01); *G10K 11/17873* (2018.01); *H04R 1/025* (2013.01);
(Continued)

(58) Field of Classification Search
CPC ..... G10K 15/02; G10K 11/17873; G10K 2210/1282; G10K 2210/3044;
(Continued)

(56) References Cited

U.S. PATENT DOCUMENTS 6,959,094 B1 10/2005 Cascone et al.
8,155,343 B2 4/2012 Honji et al.
(Continued)

FOREIGN PATENT DOCUMENTS

JP 2008247342 A 10/2008
JP 2009244959 A 10/2009
WO 2011092833 A1 8/2011

OTHER PUBLICATIONS

International Search Report and Written Opinion of PCT/US2018/035414 dated Feb. 27, 2019, 11 pages.
(Continued)

*Primary Examiner* — Fan S Tsang
*Assistant Examiner* — Daniel R Sellers
(74) *Attorney, Agent, or Firm* — Brooks Kushman P.C.

(57) ABSTRACT

A vehicle sound synthesis system is provided with a controller and a loudspeaker. The controller is programmed to receive an input indicative of at least one of a gear selection, an engine speed, and a pedal position and to generate an audio signal indicative of synthesized engine noise (SEN). The controller is further programmed to attenuate the audio signal at a first rate in response to at least one of the gear selection, the engine speed, and the pedal position indicating first vehicle conditions. The loudspeaker is adapted to project sound within a passenger compartment of a vehicle in response to receiving the attenuated audio signal.

20 Claims, 6 Drawing Sheets

(51) Int. Cl.
*H04R 1/02* (2006.01)
*H04R 1/08* (2006.01)

(52) U.S. Cl.
CPC ..... *H04R 1/08* (2013.01); *G10K 2210/1282* (2013.01); *G10K 2210/3044* (2013.01); *H04R 2430/01* (2013.01); *H04R 2499/13* (2013.01)

(58) Field of Classification Search
CPC ..... H04R 1/025; H04R 1/08; H04R 2430/01; H04R 2499/13
See application file for complete search history.

(56) References Cited

U.S. PATENT DOCUMENTS

| | | | | |
|---|---|---|---|---|
| 9,536,510 | B2 | 1/2017 | Christoph | |
| 2007/0147626 | A1* | 6/2007 | Casey | G10K 15/02 381/61 |
| 2008/0192954 | A1* | 8/2008 | Honji | G10K 15/04 381/86 |
| 2011/0010269 | A1 | 1/2011 | Ballard | |
| 2012/0106748 | A1 | 5/2012 | Peachey et al. | |
| 2012/0130580 | A1* | 5/2012 | Omote | G10K 15/02 701/22 |
| 2012/0177214 | A1* | 7/2012 | Hera | G10K 15/02 381/73.1 |
| 2012/0257763 | A1* | 10/2012 | Bowden | G10K 11/1783 381/71.4 |
| 2012/0323442 | A1 | 12/2012 | Tanaka et al. | |
| 2017/0096101 | A1 | 4/2017 | Bailey, III et al. | |

OTHER PUBLICATIONS

International Preliminary Report on Patentability of PCT/US2018/035414 dated Dec. 10, 2020, 8 pages.
Extended European Search Report of European application No. 18920332.6 dated Dec. 14, 2021, 8 pages.
Office Action of Japanese patent application No. 2020-5641555 dated Jun. 30, 2022, 17 pages.

* cited by examiner

SYSTEM AND METHOD FOR STEADY STATE VEHICLE SOUND SYNTHESIS

CROSS-REFERENCE TO RELATED APPLICATION

This application is the U.S. national phase of PCT Application No. PCT/US2018/035414 filed on May 31, 2018, the disclosure of which is incorporated in its entirety by reference herein.

TECHNICAL FIELD

One or more embodiments relate to a vehicle system and method for synthesizing sound during steady state conditions.

BACKGROUND

Vehicles include components that generate noise that is typically audible to a driver and any passengers within the passenger compartment. For example, a driver may hear noise generated by an engine of a powertrain and exhaust system of the vehicle. Such noise may be reduced or absent in new vehicle architectures and driving modes. For example, an electric vehicle does not include an internal combustion engine, and therefore does not generate engine noise. The absence of engine noise may be unexpected for a driver. Therefore, a vehicle audio system may generate synthetic noise that represents typical or expected noise generated while operating the vehicle.

SUMMARY

In one or more embodiments, a vehicle sound synthesis system is provided with a controller and a loudspeaker. The controller is programmed to receive an input indicative of at least one of a gear selection, an engine speed, and a pedal position. The controller is further programmed to generate an audio signal indicative of synthesized engine noise (SEN), and to attenuate the audio signal at a first rate in response to at least one of the gear selection, the engine speed, and the pedal position indicating first vehicle conditions. The loudspeaker is adapted to project sound within a passenger compartment of a vehicle in response to receiving the attenuated audio signal.

In one or more embodiments, a vehicle system is provided with a controller that is configured to generate an audio signal indicative of synthesized engine noise (SEN), and to attenuate the audio signal at a first rate in response to at least one of a gear selection, an engine speed, and a pedal position indicating first vehicle conditions. The controller is further configured to provide the attenuated audio signal to a loudspeaker mounted within a vehicle passenger compartment.

In one or more embodiments, a computer-program product embodied in a non-transitory computer readable medium that is programmed for synthesizing engine noise (SEN) is provided. The computer-program product comprises instructions for: receiving input indicative of at least one of gear selection, engine speed, and pedal position; and generating an audio signal indicative of SEN. The computer-program product further comprises instructions for: attenuating the audio signal at a first rate in response to the input indicating first vehicle conditions; and providing the attenuated audio signal to a loudspeaker mounted within a vehicle passenger compartment.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. In addition, flow charts are shown that contain a number of steps, and the steps are possible to execute in alternate orders, and in some embodiments, multiple steps are happening concurrently. Therefore, specific structural and functional details disclosed herein are not to be interpreted as limiting, but merely as a representative basis for teaching one skilled in the art.

Figure 1:
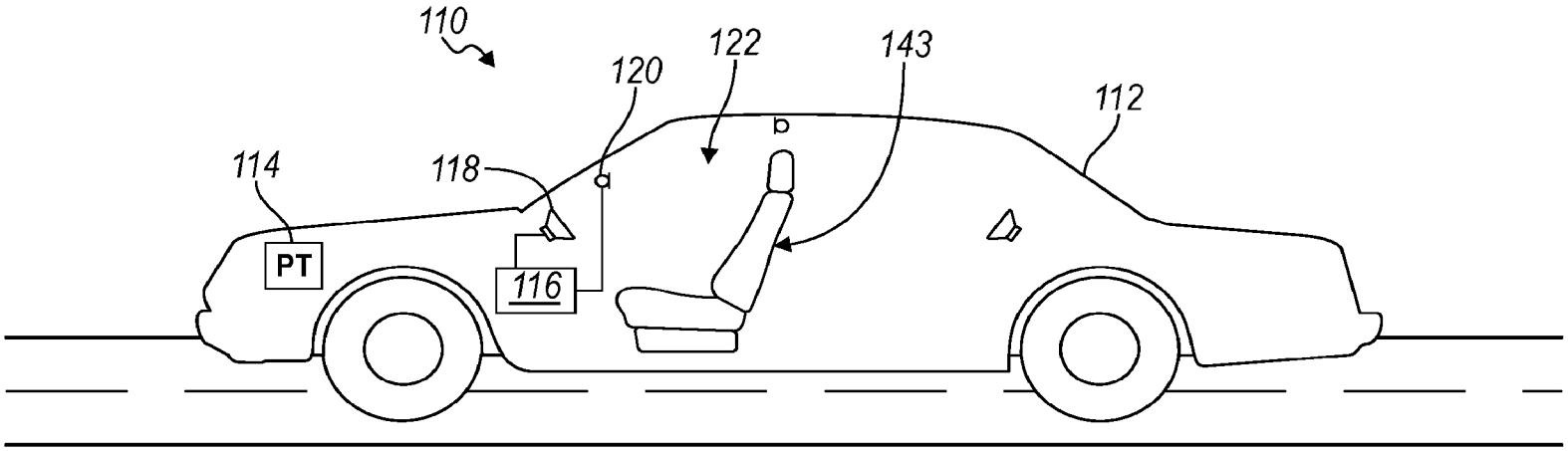
FIG. 1 is a schematic diagram of a vehicle system for synthesizing sound during steady state conditions according to one or more embodiments.

With reference to FIG. 1, a vehicle system for synthesizing sound is illustrated in accordance with one or more embodiments and generally represented by numeral 110. The vehicle system 110 is depicted within a vehicle 112. The vehicle 112 includes a powertrain 114, which may include an internal combustion engine (ICE). The vehicle system 110 includes a controller 116, at least one loudspeaker 118, and in certain embodiments, at least one microphone 120.

A driver may expect to hear noise from the powertrain 114 within a passenger compartment 122 of the vehicle 112 during certain driving modes or maneuvers. Such powertrain noise may be reduced or absent in new vehicle architectures and driving modes. The controller 116 communicates with one or more vehicle controllers (not shown) to monitor various vehicle components and systems, such as the powertrain 114 under current driving conditions. The controller 116 generates a synthesized engine noise (SEN) signal that aides the driving experience by providing audible feedback of the vehicle's driving dynamics (e.g., acceleration, cruising, deceleration, reverse, startup, shutdown), which is provided to the loudspeaker 118 and projected as audio that is audible within the passenger compartment 122. This SEN combines with the actual engine sound to produce the total engine sound heard by the driver. This total engine sound combines with other sounds in the passenger compartment to form the soundscape experienced by the driver. Although a driver may expect to hear noise from the powertrain 114 during certain transient driving modes or maneuvers, the driver may find such noise unpleasant or fatiguing during steady state driving conditions. Therefore, the controller 116 adjusts or attenuates the SEN in response to a determination that the vehicle is operating under certain steady state conditions. The SEN term as used herein may refer to audible airborne sound, and to an electrical signal that is sent to an amplifier and then to a speaker to become the audible sound.

Figure 2:
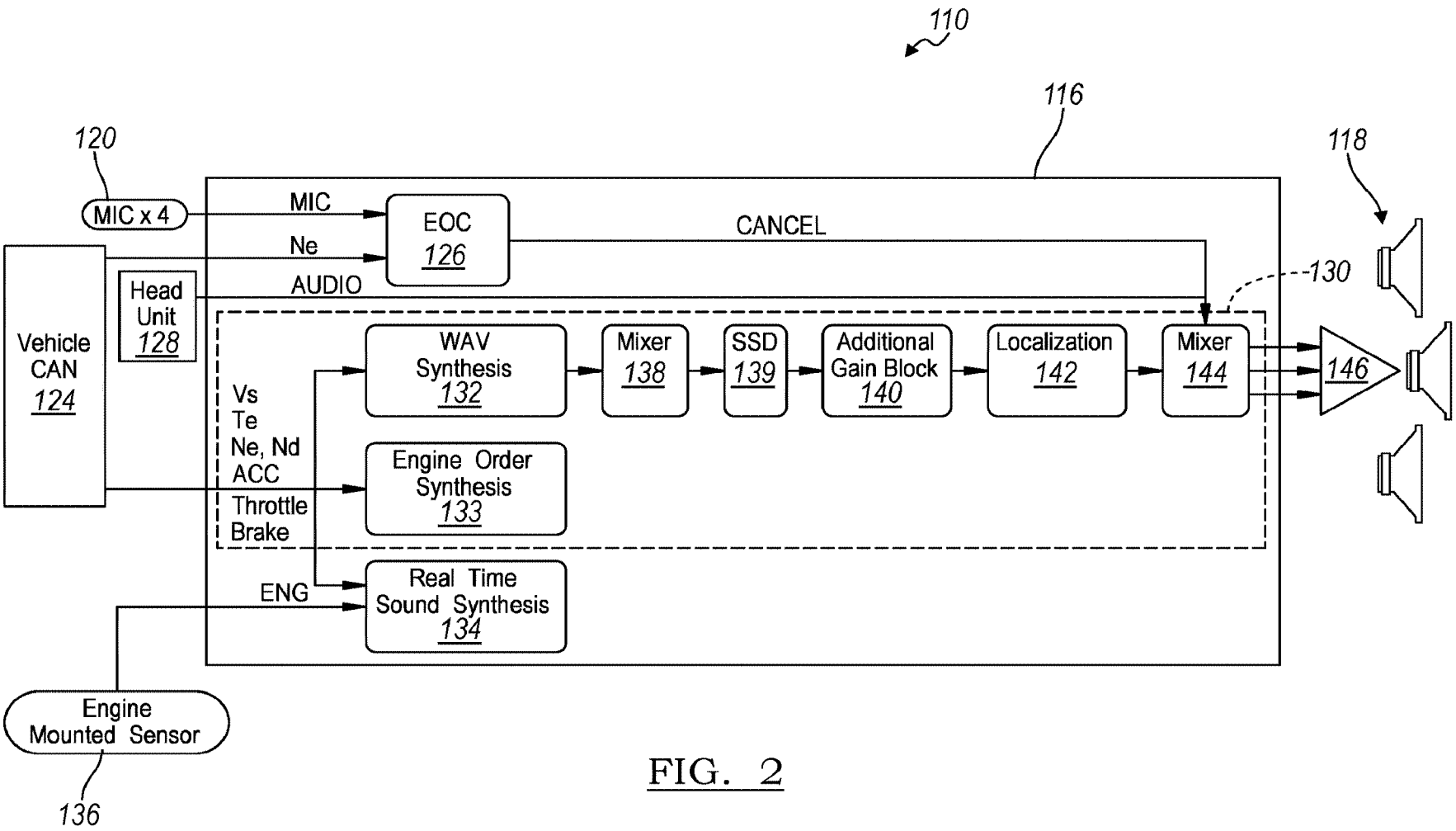
FIG. 2 is a schematic block diagram of the vehicle system of FIG. 1.

Referring to FIGS. 1-2, the controller 116 communicates with other vehicle systems and controllers via one or more vehicle networks by wired or wireless communication. The vehicle network may include a plurality of channels for communication. One channel of the vehicle network may be a serial bus such as a Controller Area Network (CAN) 124. One of the channels of the vehicle network may include an Ethernet network defined by Institute of Electrical and Electronics Engineers (IEEE) 802 family of standards. Additional channels of the vehicle network may include discrete connections between modules and may include power signals. Different signals may be transferred over different channels of the vehicle network. For example, video signals may be transferred over a high-speed channel (e.g., Ethernet) while control signals may be transferred over CAN or discrete signals. The vehicle network may include any hardware and software components that aid in transferring signals and data between modules and controllers.

Although the controller 116 is shown as a single controller, it may contain multiple controllers, or it may be embodied as software code within one or more other controllers. The controller 116 generally includes any number of microprocessors, ASICs, ICs, memory (e.g., FLASH, ROM, RAM, EPROM and/or EEPROM) and software code to co-act with one another to perform a series of operations. The controller 116 includes predetermined data, or "look up tables" that are stored within the memory, according to one or more embodiments.

The controller 116 includes an Engine Order Cancellation (EOC) module 126 according to one or more embodiments. The EOC module 126 cancels, reduces, or masks the actual engine sound. The controller 116 receives a microphone signal, or signals, (MIC) that represents sound measured by one or more microphones 120 within the passenger compartment 122. In one or more embodiments, the vehicle 112 includes four microphones 120 that are mounted at different locations within the passenger compartment 122, and the controller 116 receives four corresponding MIC signals. The controller 116 also receives signals that represent the rotational speed of the engine (Ne) and the rotational speed of the drive shaft (Nd). Using these signals (MIC, and Ne or Nd), the EOC module 126 generates a signal (CANCEL) to cancel or reduce specific engine orders, as perceived at specific locations within the passenger compartment 122, e.g., near the ears of the driver.

The vehicle 112 includes a vehicle audio system that includes the controller 116, the loudspeaker(s) 118 and a head unit 128. The controller 116 receives audio signals (AUDIO) from the head unit 128. Like the controller 116, the head unit 128 generally includes any number of microprocessors, ASICs, ICs, memory (e.g., FLASH, ROM, RAM, EPROM and/or EEPROM) and software code to co-act with other controllers to perform a series of operations. The controller 116 includes a SEN module 130 for generating synthetic engine sound or noise. The SEN module 130 receives numerous guiding signals from the CAN bus 124, such as vehicle speed (VS), engine torque (Te), engine speed (Ne), and throttle (THROTTLE) position. In one or more embodiments, the SEN module 130 also receives signals that represent: accelerator pedal position (ACC), brake pedal position (BRAKE), and cruise control (CRUISE). The controller 116 illustrated in FIG. 2 receives multiple guiding signals, however alternate embodiments of the controller 116 receive fewer, alternate and/or additional guiding signals.

In one or more embodiments, the SEN module 130 includes a WAV Synthesis block 132 that plays back a filtered, modified, or augmented audio bitstream that is generated from a Waveform (WAV) Audio File and represents synthetic engine sound or synthetic engine noise. In one or more embodiments, the WAV Synthesis block 132 generates the audio bitstream. The WAV Synthesis block 132 also includes features for modulating the characteristics of the audio bitstream, e.g., playback rate, frequency dependent filtering, and/or amplitude. In one or more embodiments, the SEN module 130 also includes an Engine Order Synthesis block 133 that generates an engine order signal based on, for example, engine order frequencies and levels found in lookup tables for the engine speed or vehicle speed.

The controller 116 also includes a Real Time Sound Synthesis Module 134 according to one or more embodiments. The Real Time Sound Synthesis Module 134 receives an engine signal (ENG) that represents the current vibroacoustic emissions of the engine. The ENG signal may be derived from a pressure or vibration sensor 136 that is mounted in proximity to the engine and/or emissions system. In an embodiment, the Real Time Sound Synthesis Module 134 processes the ENG signal into individual engine orders that may then be individually filtered, equalized and then provided to a Mixer block 138 to be combined with the output of the WAV Synthesis block 132 and the Engine Order Synthesis block 133. In an alternate embodiment, the ENG signal may be filtered and provided to the Mixer block 138 to create the desired real time SEN characteristics.

The SEN module 130 includes a Steady State Detector (SSD) block 139 that receives the output of the Mixer block 138 and one or more of the guiding signals; and then identifies steady state conditions using a method for synthesizing sound during steady state conditions as described in detail below with reference to FIGS. 3-10. The SEN module 130 also includes an Additional Gain Block (AGB) 140 for attenuating the gain based on the detection of steady state conditions. The gain is expressed using the logarithmic decibel (dB) units. A gain of 1 corresponds to zero dB and represents a pass-through condition where the AGB 140 passes SEN without modification. A gain greater than one (positive dB) refers to amplification, and a gain less than one (negative dB) refers to reduction.

In one or more embodiments, the SEN module 130 includes a Localization block 142 that receives the audio signal from the AGB 140 and generates a sound image of where the engine would typically be located relative to the loudspeaker 118. For example, in one or more embodiments, the Localization block 142 generates a sound image for the SEN that corresponds to a location three to four feet forward of a loudspeaker 118 located in a headrest of a driver seat 143.

The SEN module 130 includes a Mixer 144 for combining the localized SEN output of the Localization block 142, with the CANCEL and AUDIO signals. The controller 116 provides the SEN signal(s) to one or more power amplifiers 146, which in turn provides amplified SEN signals to the loudspeakers 118. The vehicle audio system 110 amplifies and plays through the vehicle loudspeakers 118 to provide the vehicle occupants, especially the driver, real time audible feedback of the vehicle's operating state.

The original engine sound present at the locations of the passengers' ears, as measured by the microphones 120, may be effectively canceled or reduced using an EOC module 126, enabling the character of the original engine sound to be replaced by that of the SEN played through loudspeakers 118. That is by first dramatically reducing the level of the actual engine noise at the locations of the passengers' ears using the EOC module 126, the controller 116 lowers the overall sound pressure level, including the contribution of the SEN, at the location of the passenger's ears. It is often desirable to achieve the lowest overall engine sound pressure level at the location of the listener's ears that has the desired sonic characteristics.

The vehicle system 110 is applicable to vehicles 112 having different powertrains 114. In one or more embodiments, the vehicle 112 is a conventional vehicle with a powertrain 114 that includes a four-cylinder internal combustion engine. Such four-cylinder engines naturally radiate certain engine orders—mainly the 2nd, 4th, 6th, and 8th orders of the engine output shaft rotational speed. The vehicle system 110 synthesizes additional engine orders: 2.5, 4.5, and 6.5 engine orders, e.g., using the Engine Order Synthesis block 133, to add a racier character to the engine's sound signature.

In another embodiment, the vehicle 112 is an auto-start stop vehicle with a powertrain 114 that includes an engine that is controlled to stop or shut-off when the vehicle stops for a short period of time, e.g., at a traffic light, and then restart to provide propulsion. This start/stop technology is employed to increase fuel efficiency. In various embodiments, the vehicle system 110 generates SEN to remove or mask the abrupt audible transition when the engine turns off or restarts using various combinations of the Engine Order Synthesis module 133 and the WAV Synthesis module 132.

In yet another embodiment, the vehicle 112 is a hybrid electric vehicle (HEV) with a powertrain 114 that includes an engine and an electric motor that be controlled, alone or in combination, to propel the vehicle. The vehicle system 110 generates SEN, using the SEN module 130, when the HEV 112 is operating in electric mode, i.e., the electric motor alone is operated for propulsion in order to provide the audible engine sound signature of a gasoline powered engine that the driver and vehicle occupants may be more accustomed to. This added sound aides the driving experience by providing audible feedback of the vehicles driving dynamics (acceleration, cruising, and deceleration, reverse, startup, shutdown, etc.). Fully electric vehicles, and HEVs operating in EV mode, have an internal soundscape that consists primarily of vehicle suspension noise, vibration and harness (NVH) and electric motor whine, the latter of which is harmonically sparse. Often the sound signature of motor whine is viewed as undesirable, due both to its high frequency nature, and the lack of harmonic complexity. Naturally other sounds are present in the passenger compartment.

In other embodiments, the vehicle system 110 replaces the audible character of the engine by an entirely different sound signature. In this case, the vehicle system 110 reduces the audible level of the engine and/or electric motor using the EOC module 126. This EOC module 126 reduces the overall level of individual engine orders, and therefore reduces the total level of engine noise in the passenger compartment at the locations of the vehicle occupants. Then, a SEN may be played through the loudspeakers 118, and the original sound at the locations of the passengers' ears may be effectively replaced, or masked, by that of the SEN. By first dramatically reducing the level of the actual engine noise at the locations of the passengers' ears, the overall sound pressure level including the contribution of the SEN at the location of the passenger's ears is lower than it otherwise would be without employing the EOC system. It is often desirable to achieve the lowest overall engine sound pressure level at the location of the listener's ears that has the desired sonic characteristics.

In an EV or HEV, the driver may not receive audible feedback after starting the vehicle, if the vehicle starts without any traditional engine sound. In this type of vehicle, the vehicle system 110 synthesizes engine-like sounds, i.e., SEN, and plays it through the loudspeakers 118 to provide a more traditional engine start up vehicle experience. The SEN may be of any sonic character, and need not mimic an engine. In one or more embodiments, the SEN resembles sounds that are not typical of an automotive engine, e.g., a jet engine for an aircraft. This SEN may start when the vehicle's power button (not shown) is pressed, and helps provide an audible feedback to the driver that the vehicle is powered on. This SEN continues to be played through the loudspeakers 118 to give the driver audible feedback as to the state of the vehicle—whether at idle, accelerating, decelerating, or just cruising.

As previously mentioned, SEN generation systems coupled with EOC systems have the capability to mask existing engine sound with more desirable synthesized engine-like sounds and or to enhance existing engine sounds to play in the passenger compartment 122 of the vehicle 112. Most of the synthesized engine sounds in these systems are tuned using one or more reference CAN signals such as vehicle speed (VS), throttle (or ACC), engine torque (Te), in order to naturally integrate these sounds into the vehicle. The synthesized engine sound is played at a level that is somewhat subtle, it should not be played so loud that it annoys or fatigues occupants of the vehicle. In some cases, the interior sound pressure level of the passenger cabin is a metric of quality: quieter cabins may be a sign of a luxury vehicle.

Often, a goal of creating SEN is to provide the vehicle's driver a form of audible feedback of the vehicle's current operating state. It is often important for the SEN to be of relatively high amplitude for a short duration to signal a change in vehicle operating state and then for the SEN level to be reduced so as not to fatigue the vehicle occupants. For example, with hybrid vehicles operating in electric mode, or with pure electric vehicles, there is no engine idle sound. That is, the powertrain of the vehicle is completely silent when the wheels are not turning. The driver, therefore, has no audible indication that the vehicle is powered on, even if the transmission is in drive and not park. In the case of vehicle acceleration, the vehicle's driver is accustomed to the amplitude of the engine noise increasing as the vehicle speed increases, as is the behavior of an ICE. To mimic this behavior with SEN, the accelerator pedal position (ACC) and the engine torque (Te) are used, by the WAV Synthesis block 132 and the Engine Order Synthesis block 133, as guiding signals to increase the amplitude of the synthetic engine sound. Drivers are also accustomed to the pitch of the engine orders increasing as the vehicle speed increases, as is also the behavior of an ICE. To mimic this behavior, the engine shaft rotational speed (Ne), wheel speed, or vehicle speed (Vs) is used as a guiding signal to the WAV Synthesis block 132 of the SEN module 130 to adjust the pitch of the synthetic engine orders or SEN. After a predetermined period of time, the SEN level is reduced by controlling the AGB 140 according to a method for synthesizing sound during steady state conditions, so as not to fatigue the vehicle occupants.

Referring to FIGS. 3-12, the vehicle system 110 includes one or more algorithms or methods for synthesizing sound during steady state conditions. The methods are implemented using software code contained within the controller 116 (shown in FIG. 2) according to one or more embodiments. While the methods are described using flowcharts that are illustrated with a number of sequential steps, one or more steps may be omitted and/or executed in another manner in one or more other embodiments.

A simplified SEN strategy (not shown) could generate SEN with an amplitude that is proportional to engine characteristics, such as engine torque, throttle, and/or accelerator pedal position. However, such a strategy could result in SEN that is undesirable or fatiguing to the driver over a long period of time. For example, driving up steep inclines and towing a trailer at highway speeds results in high engine torque conditions for an extended period of time. The high level of SEN generated by such a SEN strategy during such steady state conditions may be undesirable, as it may become fatiguing to listeners over a period of time.

Figure 3:
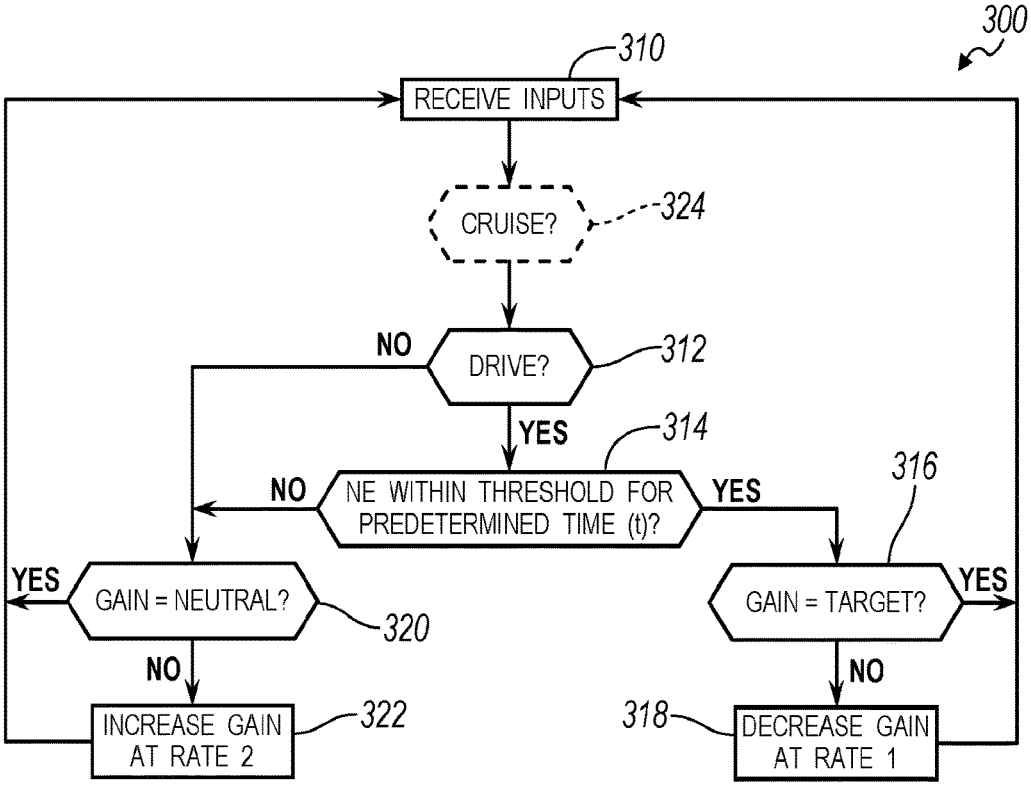
FIG. 3 is a flow chart illustrating a method for synthesizing sound during steady state conditions associated with vehicle cruising, according to one or more embodiments.

With reference to FIG. 3, a method for synthesizing sound during steady state conditions associated with vehicle cruising is illustrated according to one or more embodiments, and generally referenced by numeral 300. Generally, the method adds a time dependency to the SEN generation algorithm to gradually reduce the SEN during steady state vehicle cruising conditions.

At step 310, the controller 116 receives input that is indicative of a gear selection (PRNDL) and engine speed (Ne). Then at steps 312-314, the controller 116 evaluates the input to determine if steady state conditions associated with vehicle cruising are met. At step 312, the controller 116 evaluates the drive selection to determine if DRIVE is selected. If DRIVE is selected, the controller proceeds to step 314. At step 314, the controller 116 evaluates the engine speed (Ne) to determine if Ne is within a threshold range (THRESHOLD) for a predetermined period of time (t). In one or more embodiments, an average speed value (Navg) may be calculated using a rolling average with a buffer. In another embodiment, the average speed value may be a predetermined value, e.g., 2,500 rpm. The threshold range may be a percentage (e.g., +/−4%) of the average speed value in one or more embodiments. If the steady state conditions are met, i.e., a positive determination at steps 312 and 314, the controller 116 proceeds to step 316. In other embodiments, the controller 116 receives input indicative of vehicle speed (VS) and/or drive shaft rotational speed (Nd) at step 310; and then compares VS or Nd to a threshold range at step 314. In alternate embodiments, the drive selection step 312 is omitted and controller 116 proceeds directly from step 310 to step 314. In other embodiments, the controller 116 receives additional and/or alternate inputs at step 310.

At step 316, the controller 116 evaluates the current gain setting (GAIN) of the Additional Gain Block (AGB) 140 to determine if GAIN is currently set to a maximum target value (TARGET). The TARGET corresponds to a maximum reduction of the SEN in decibels (dB). In one or more embodiments, TARGET may be equal to −6 dB, which means that the method will reduce the SEN up to 6 dB below an expected engine noise during similar driving conditions. If GAIN is equal to TARGET, the controller 116 returns to step 310. Otherwise, the controller proceeds to step 318 and decreases the GAIN at a predetermined reduction rate or rate of decrease (RATE 1). RATE 1 may be equal to value between −0.5 and −0.33 dB per second (i.e., 1 dB every 2-3 s), according to one or more embodiments. In one or more embodiments, the THRESHOLD may be equal to +4% of a rolling average; the predetermined time (t) may be 20 seconds; RATE 1 may be −0.4 dB/s (i.e., 1 dB every 2.5 s); and TARGET may be −6 dB. Other embodiments include different detection durations (predetermined time), RPM tolerances (THRESHOLD), reduction rates (RATE 1), and total reduction amounts (TARGET). After step 318, the controller 116 returns to step 310. Using this approach, the controller 116 gradually reduces the SEN during steady state cruising conditions.

Figure 4:
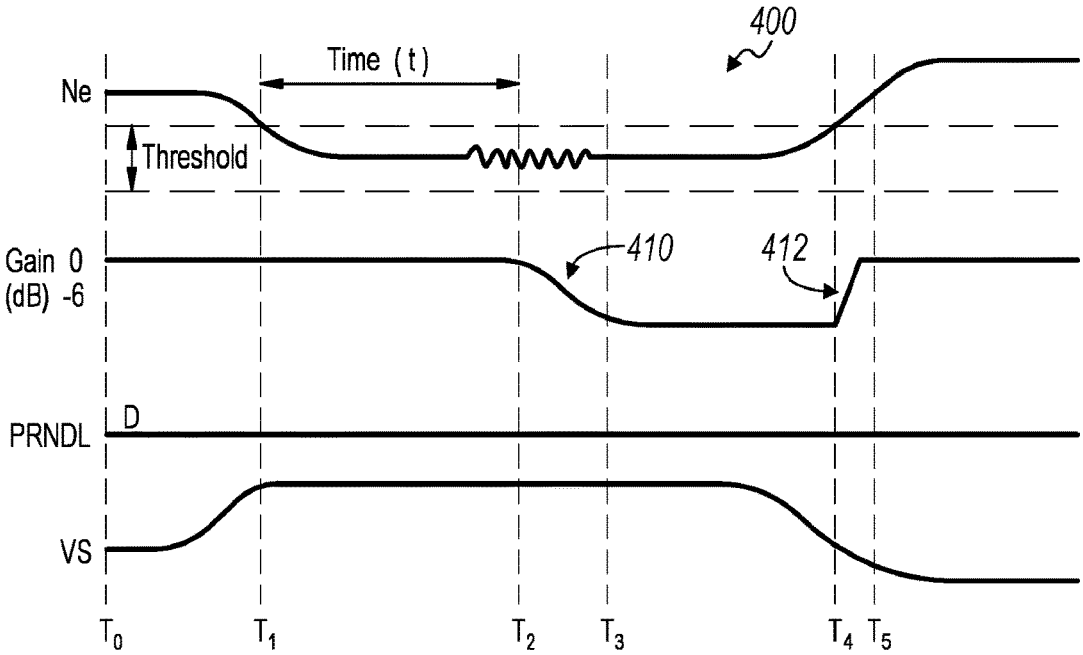
FIG. 4 is a graph illustrating how various parameters of the vehicle system of FIG. 1 change over time due to the method of FIG. 3.

FIG. 4 is a graph 400 that illustrates an example of the impact of the method 300 for synthesizing sound during steady state vehicle cruising conditions. The graph 400 includes four curves representing engine speed (Ne), the adjustable gain of the AGB 140 (GAIN), gear selection (PRNDL), and vehicle speed (Vs). The gear selection is set to drive (D) for the time period shown on graph 400. At time T1, engine speed (Ne) decreases within the threshold range (THRESHOLD), and Ne remains within THRESHOLD for predetermined time (t). At time T2, the controller 116 determines that both steady state cruising conditions are met as described in steps 312 and 314, i.e., the DRIVE gear is selected, and Ne is within the THRESHOLD range for the predetermined time (t), and therefore starts reducing the GAIN at RATE 1, as depicted by reference numeral 410. At time T3, the controller 116 determines that GAIN is equal to the TARGET of −6 dB, and then stops decreasing the GAIN, as described with reference to step 316.

Referring back to FIG. 3, when the steady state cruising conditions are no longer met, i.e., a negative determination is made at step 312 or step 314, the controller proceeds to step 320. At step 320, the controller 116 evaluates the current gain setting (GAIN) of the Additional Gain Block (AGB) 140 to determine if GAIN is currently set to a neutral value (NEUTRAL). The NEUTRAL value may be equal to 0 dB, which corresponds to no gain. If GAIN is not equal to neutral, the controller proceeds to step 322 and increases the RATE at a predetermined rate of increase (RATE 2). RATE 2 may be equal to value between 4 and 6 dB per second, according to one or more embodiments. In one or more embodiments, RATE 2 may be equal to 6 dB/s. The absolute value of RATE 2 may be greater than the absolute value of RATE 1 to allow the SEN to ramp up to the expected SEN level quickly during transient, or non-steady state, conditions. Once the controller 116 determines that GAIN is equal to MIN, i.e., a positive determination at step 320, the controller 116 returns to step 310.

With reference to FIG. 4, between time T3 and T4, the steady state conditions of steps 312 and 314 are met, and the controller 116 maintains the GAIN at the TARGET value (−6 dB). After time T4, the engine speed (Ne) exceeds the THRESHOLD, and the controller 116 increases the GAIN at RATE 2, as depicted by numeral 412. At time T5, the controller 116 determines that GAIN is equal to the MIN value of 0 dB, and then stops increasing the GAIN, as described with reference to step 320.

In another embodiment of the method 300, the controller 116 also receives a cruise control (CRUISE) signal, that represents whether cruise is enabled or disabled, at step 310. After step 310, the controller 116 proceeds to step 324 and evaluates CRUISE to determine if cruise is enabled. This condition may be an additional condition, or an alternate condition to the gear selection of DRIVE condition (i.e., step 312). Cruise control does not maintain the vehicle at a constant speed or RPM, even on flat pavement. Cruise control typically maintains engine RPM and vehicle speed within 2 or 3 percent on flat pavement. Typical values may be 2500+/−50 RPM, or 60+/−1.5 mph. Similarly, a person operating a vehicle will also typically be unable to maintain the vehicle at an exactly constant speed or RPM, which typical values on flat pavement varying slightly more, at +/−5% or slightly higher. In another embodiment, steps 312 and 314 are omitted, and the controller 116 proceeds from step 324 to step 316 after determining that cruise control is enabled for a predetermined period of time.

Figure 5:
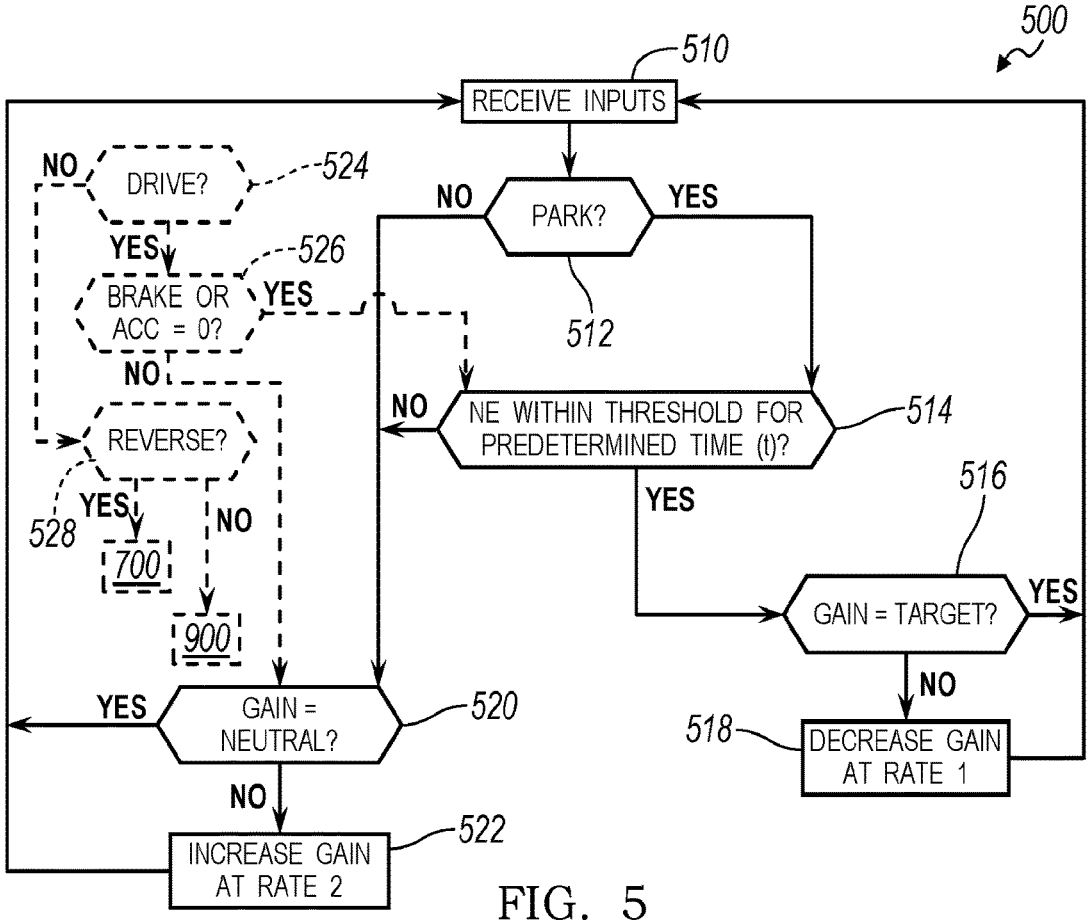
FIG. 5 is a flow chart illustrating a method for synthesizing sound during steady state conditions associated with engine idling, according to one or more embodiments.

With reference to FIG. 5, a method for synthesizing sound during steady state conditions associated with engine idle is illustrated according to one or more embodiments, and generally referenced by numeral 500. Generally, the method adds a time dependency to the SEN generation algorithm to gradually reduce the SEN during steady state engine idle conditions.

At step 510, the controller 116 receives input that is indicative of a gear selection (PRNDL), engine speed (Ne), accelerator pedal positions (ACC), and brake pedal position (BRAKE). Then at steps 512-514, the controller 116 evaluates the input to determine if steady state conditions associated with engine idle conditions are met. In other embodiments, the controller 116 receives additional and/or alternate inputs at step 510.

At step 512, the controller 116 evaluates the drive selection to determine if PARK is selected. If PARK is selected, the controller proceeds to step 514. At step 514, the controller 116 evaluates the engine speed (Ne) to determine if Ne is within a threshold range for a predetermined period of time (t). In one or more embodiments, an average speed value (Navg) may be a predetermined value, e.g., 0 rpm, which indicates that the engine is off. In another embodiment, the average speed value may be calculated using a rolling average with a buffer. The threshold range may be a percentage (e.g., +/−4%) of the average speed value in one or more embodiments. If the steady state conditions are met, i.e., a positive determination at steps 512 and 514, the controller 116 proceeds to step 516. In an alternate embodiment, step 514 is omitted, and the controller 116 proceeds from step 512 to step 516 after PARK is selected for longer that a predetermined time (t).

At step 516, the controller 116 evaluates the current gain setting (GAIN) of the Additional Gain Block (AGB) 140 to determine if GAIN is currently set to a maximum target value (TARGET). The TARGET corresponds to a maximum reduction of the SEN in decibels (dB). In one or more embodiments, TARGET may be equal to −6 dB, which means that the method will reduce the SEN up to 6 dB below an expected engine noise during similar driving conditions. If GAIN is equal to TARGET, the controller 116 returns to step 510. Otherwise, the controller proceeds to step 518 and decreases the GAIN at a predetermined reduction rate or rate of decrease (RATE 1). RATE 1 may be equal to value between −0.5 and −0.33 dB per second (i.e., 1 dB every 2-3 s), according to one or more embodiments. In one or more embodiments, the THRESHOLD may be equal to +4% of a rolling average; the predetermined time (t) may be 20 seconds; RATE 1 may be −0.4 dB/s (i.e., 1 dB every 2.5 s); and TARGET may be −6 dB. Other embodiments include different detection durations (predetermined time), RPM tolerances (THRESHOLD), reduction rates (RATE 1), and total reduction amounts (TARGET). After step 518, the controller 116 returns to step 510. Using this approach, the controller 116 gradually reduces the SEN during steady state engine idle conditions.

In one or more embodiments, the method 500 is implemented in an HEV. In a typical HEV, when the power button is pressed, the vehicle is powered on but there is no traditional audible indicator, such as the sound of the engine starting and running, because the engine is not running. The method 500 achieves this engine idle sound play for a short duration at a relatively high level to indicate to the driver and passengers that a state change has occurred (the vehicle is now on). Then, the amplitude of this synthetic idle sound may be decreased by 1 dB per 2.5 seconds, which again is 6 dB reduction in synthetic engine amplitude per 15 seconds. In other embodiments, the amplitude of this synthetic idle sound may be decreased by 6 dB in synthetic engine amplitude per 10 seconds. The method 500 is also applicable for conventional (non-hybrid) vehicles with SEN systems.

Figure 6:
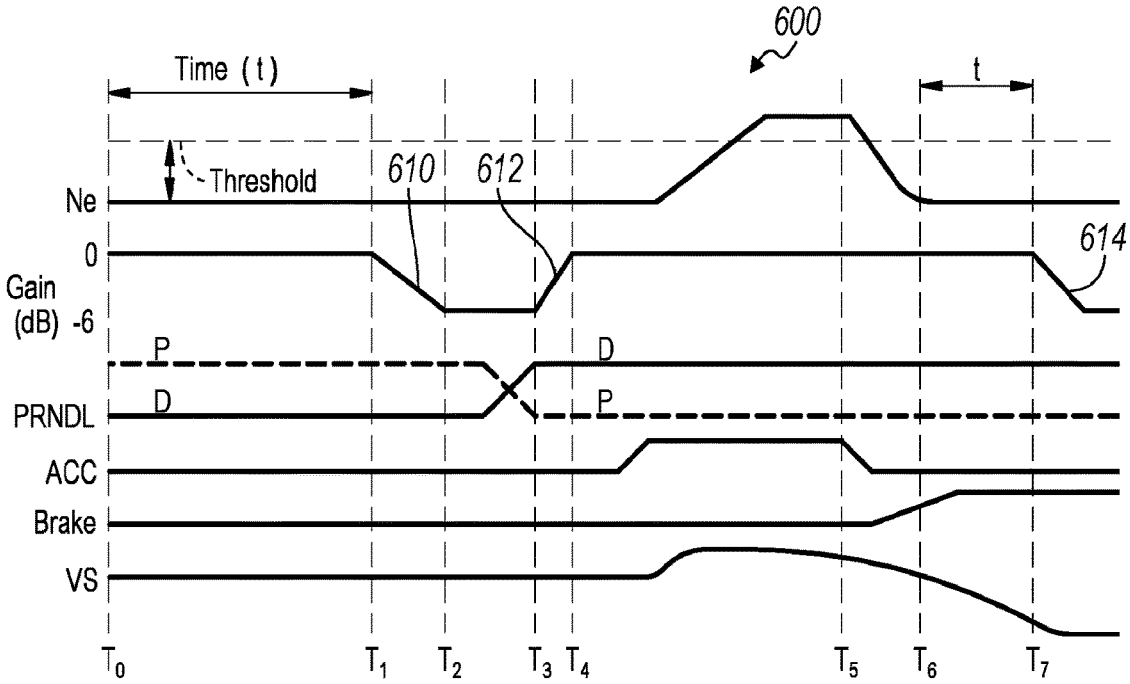
FIG. 6 is a graph illustrating how various parameters of the vehicle system of FIG. 1 change over time due to the method of FIG. 5.

FIG. 6 is a graph 600 that illustrates an example of the impact of the method 500 for synthesizing sound during steady state engine idle conditions. The graph 600 includes curves representing engine speed (Ne), the adjustable gain of the AGB 140 (GAIN), gear selection (PRNDL), Accelerator pedal position (ACC), brake pedal position (BRAKE), and vehicle speed (Vs).

At time T0, the gear selection is set to park (P) and the engine speed (Ne) is zero rpms, which is within the THRESHOLD region. Ne remains within the THRESHOLD for time period (t). At time T1, the controller 116 determines that both steady state engine idle conditions, as described in steps 512 and 514, are met, i.e., the PARK gear is selected, and Ne is within the THRESHOLD range for the predetermined time (t), and therefore starts reducing the GAIN at RATE 1, as depicted by reference numeral 610. At time T2, the controller 116 determines that GAIN is equal to the TARGET of −6 dB, and then stops decreasing the GAIN, as described with reference to step 516.

When the steady state engine idle conditions are no longer met, i.e., a negative determination is made at step 512 or step 514, the controller proceeds to step 520. At step 520, the controller 116 evaluates the current gain setting (GAIN) of the Additional Gain Block (AGB) 140 to determine if GAIN is currently set to a neutral value (NEUTRAL). The NEUTRAL value may be equal to 0 dB, which corresponds to no gain. If GAIN is not equal to NEUTRAL, the controller proceeds to step 522 and increases the RATE at a predetermined rate of increase (RATE 2). RATE 2 may be equal to value between 4 and 6 dB per second, according to one or more embodiments. In one or more embodiments, RATE 2 may be equal to 6 dB/s. The absolute value of RATE 2 may be greater than the absolute value of RATE 1 to allow the SEN to ramp up to the expected SEN level quickly during transient, or non-steady state, conditions. Once the controller 116 determines that GAIN is equal to MIN, i.e., a positive determination at step 520, the controller 116 returns to step 510.

With reference to FIG. 6, the gear selection switches from park (P) to drive (D) at time T3. After time T3, the controller 116 determines that the engine idle conditions are no longer met, i.e., a negative determination at step 512, and increases the GAIN at RATE 2, as depicted by numeral 612. At time T4, the controller 116 determines that GAIN is equal to the MIN value of 0 dB, and then stops increasing the GAIN, as described with reference to step 520.

Referring to FIG. 5, in another embodiment of the method 500, the controller 116 evaluates engine idle conditions while the vehicle is in motion. In HEVs, it is common for an engine to turn off, or idle, during regenerative braking conditions—where one or more electric motors are controlled to operate as a generator to charge a high voltage battery while braking or decelerating the vehicle.

As described previously, at step 512, the controller 116 evaluates the drive selection to determine if PARK is selected. In this embodiment, if PARK is not selected, the controller proceeds to step 524 to determine if the drive gear (DRIVE) is selected. If DRIVE is selected, the controller 116 proceeds to step 526 to evaluate the brake pedal position (BRAKE) and accelerator pedal position (ACC) signals. If the controller 116 determines that the BRAKE is applied, or the ACC is released; the controller 116 proceeds to step 514. As described previously, at step 514, the controller 116 evaluates the engine speed (Ne) to determine if Ne is within a threshold range about an average speed value (Navg) for a predetermined period of time (t). If the steady state conditions are met, i.e., a positive determination at steps 524, 526 and 514, the controller 116 proceeds to steps 516 and 518 to begin decreasing the GAIN at the reduction rate (RATE 1). If the controller 116 determines that the gear selection is not PARK (step 512) nor DRIVE (step 524), it proceeds to step 528. In one or more embodiments, if the gear selection is REVERSE, the controller 116 proceeds to the method 700 described with reference to FIG. 7. However, if the controller 116 determines that the gear selection is not DRIVE, PARK, or REVERSE, i.e., a negative determination at step 528, it may proceed to the method 900 described with reference to FIG. 9.

With reference to FIG. 6, the controller 116 maintains the GAIN at a neutral value (i.e. 0 dB) between time T4 and T5. At time T5, the driver releases the accelerator pedal, and ACC decreases, and the engine speed Ne gradually decreases to zero RPMs. At time T7, the controller 116 determines that the steady state engine idle conditions, as described in steps 524, 526 and 514, are met, i.e., the DRIVE gear is selected, the BRAKE is applied, the accelerator pedal is released (ACC=0), and Ne is within the THRESHOLD range for the predetermined time (t). After time T7, the controller 116 starts reducing the GAIN at RATE 1, as depicted by reference numeral 614.

Figure 7:
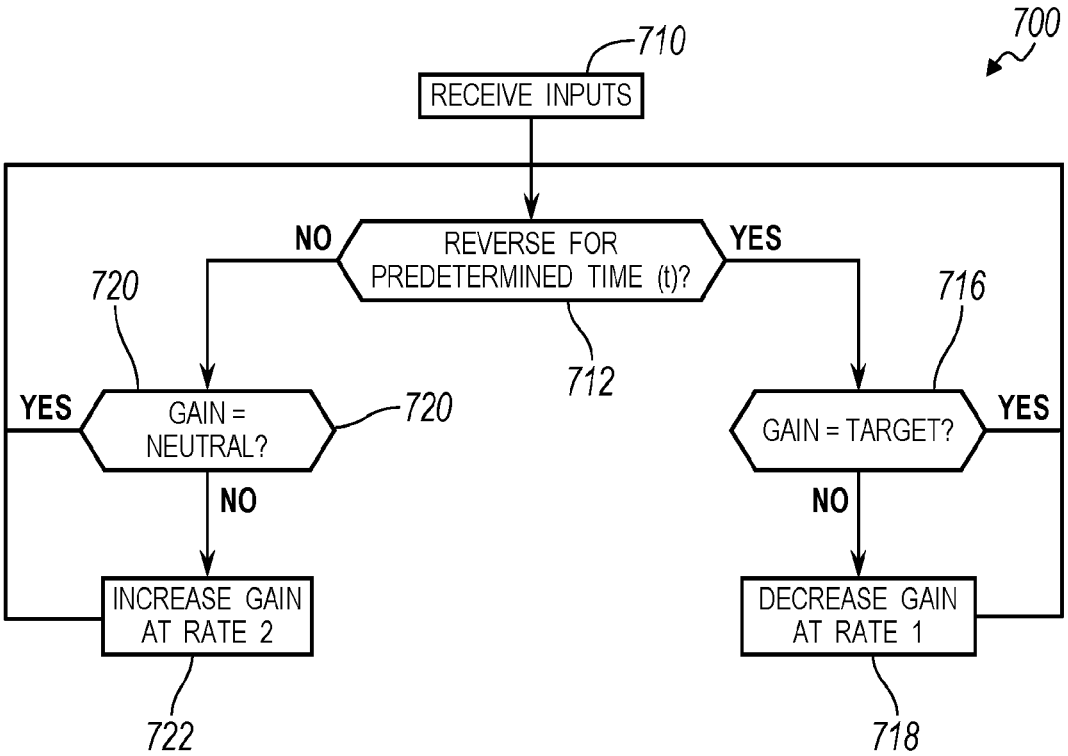
FIG. 7 is a flow chart illustrating a method for synthesizing sound during steady state conditions associated with reverse driving, according to one or more embodiments.

With reference to FIG. 7, a method for synthesizing sound during steady state conditions associated with reverse travel is illustrated according to one or more embodiments, and generally referenced by numeral 700. Generally, some vehicles play a repetitive beeping sound within the passenger compartment while the vehicle is traveling in reverse, that may become fatiguing to some drivers. The method 700 adds a time dependent SEN generation algorithm to gradually reduce the SEN during steady state reverse travel conditions.

At step 710, the controller 116 receives input that is indicative of a gear selection (PRNDL). At step 712, the controller 116 evaluates the drive selection to determine if REVERSE is selected for a predetermined period of time (t). If these conditions are met, the controller proceeds to step 716. In other embodiments, the controller 116 receives additional and/or alternate inputs at step 710.

At step 716, the controller 116 evaluates the current gain setting (GAIN) of the Additional Gain Block (AGB) 140 to determine if GAIN is currently set to a maximum target value (TARGET). The TARGET corresponds to a maximum reduction of the SEN in decibels (dB). In one or more embodiments, TARGET may be equal to −10 dB, which means that the method will reduce the SEN up to 10 dB below expected engine noise during similar driving conditions. If GAIN is equal to TARGET, the controller 116 returns to step 710. Otherwise, the controller proceeds to step 718 and decreases the GAIN at a predetermined reduction rate or rate of decrease (RATE 1). In one or more embodiments, the predetermined time (t) may be 5 seconds; RATE 1 may be −0.8 dB/s (i.e., 2 dB every 2.5 s); and TARGET may be −10 dB. Other embodiments include different detection durations (predetermined time), reduction rates (RATE 1), and total reduction amounts (TARGET). After step 718, the controller 116 returns to step 710. Using this approach, the controller 116 gradually reduces the SEN during steady state cruising conditions. In one or more embodiments, the controller 116 reduces the GAIN in a number of discrete steps, rather than at a rate. These gain reductions may be applied such that each alert beep is played at a constant level during the duration of the beep, with each subsequent beep being ever quieter, until the TARGET is been met.

Figure 8:
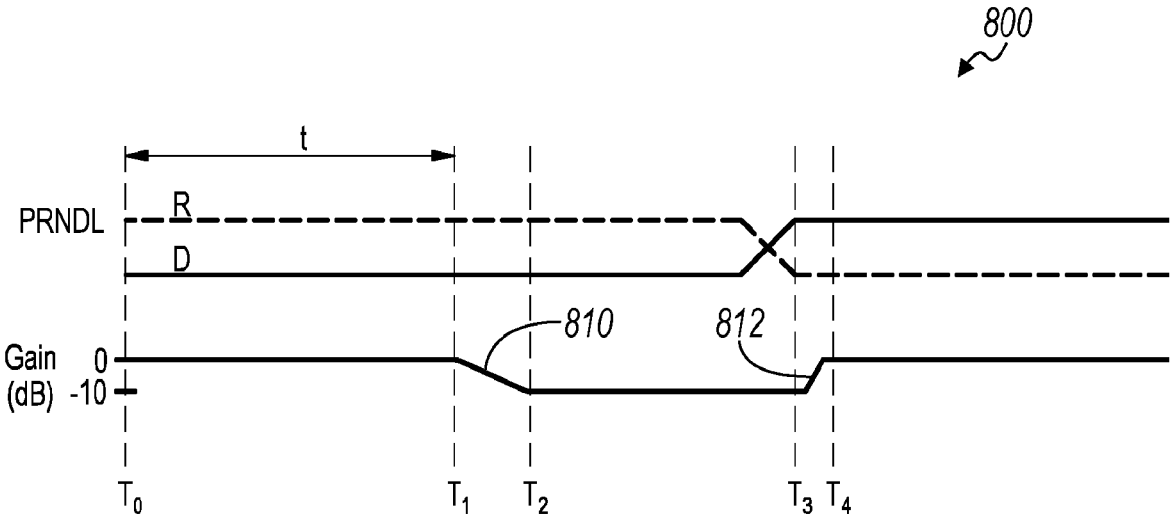
FIG. 8 is a graph illustrating how various parameters of the vehicle system of FIG. 1 change over time due to the method of FIG. 7.

FIG. 8 is a graph 800 that illustrates an example of the impact of the method 700 for synthesizing sound during steady state reverse travel conditions. The graph 800 includes curves representing gear selection (PRNDL), and the adjustable gain of the AGB 140 (GAIN). At time T0, REVERSE gear is selected.

At time T2, the controller 116 determines that the steady state reverse travel conditions are met as described in steps 712, i.e., the REVERSE gear is selected for the predetermined time (t), and therefore starts reducing the GAIN at RATE 1, as depicted by reference numeral 810. At time T2, the controller 116 determines that GAIN is equal to the TARGET of −10 dB, and then stops decreasing the GAIN, as described with reference to step 716.

Referring back to FIG. 7, when the steady state cruising conditions are no longer met, i.e., a negative determination is made at step 712, the controller proceeds to step 720. At step 720, the controller 116 evaluates the GAIN to determine if it is currently set to a neutral value (NEUTRAL). In one or more embodiments, NEUTRAL may be equal to 0 dB, which corresponds to no gain. If GAIN is not equal to NEUTRAL, the controller proceeds to step 722 and increases the RATE at a predetermined rate of increase (RATE 2). RATE 2 may be equal to value between 4 and 6 dB per second, according to one or more embodiments. Once the controller 116 determines that GAIN is equal to MIN, i.e., a positive determination at step 720, the controller 116 returns to step 710. Other embodiments include different detection durations (predetermined time), rates (RATE 2), and neutral values (NEUTRAL).

With reference to FIG. 8, between time T2 and T3, the steady state conditions of step 712 are met, and the controller 116 maintains the GAIN at the TARGET value (−10 dB). After time T3, the gear selection changes to DRIVE, and the controller 116 increases the GAIN at RATE 2, as depicted by numeral 812. At time T4, the controller 116 determines that GAIN is equal to the MIN value of 0 dB, and then stops increasing the GAIN, as described with reference to step 720.

Figure 9:
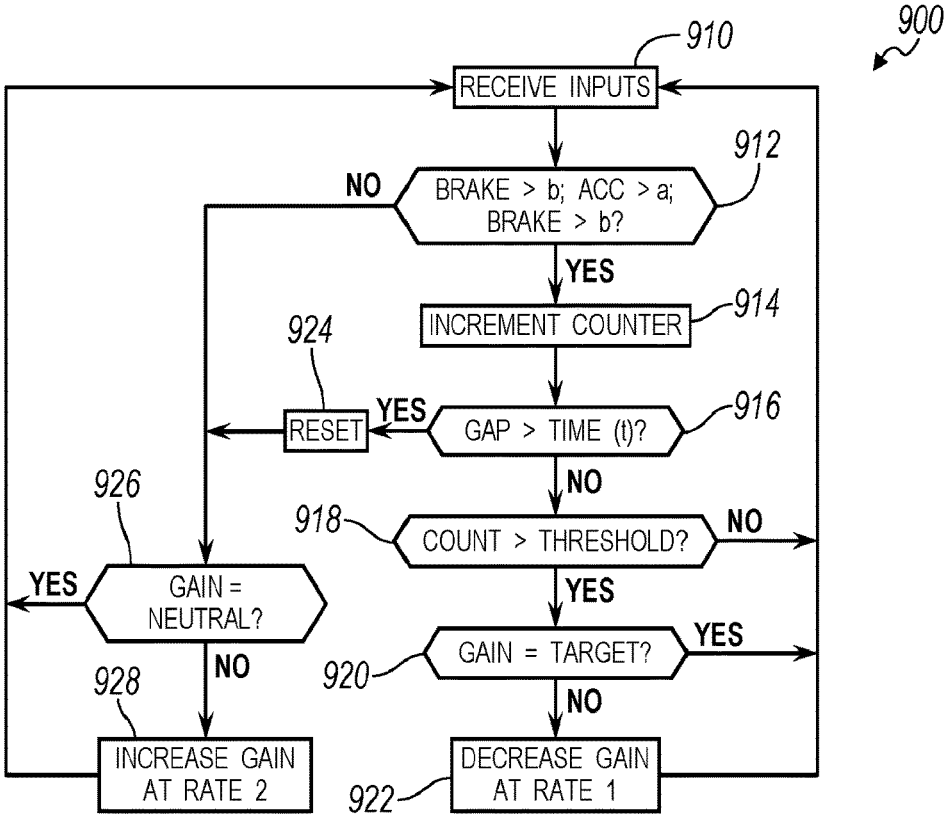
FIG. 9 is a flow chart illustrating a method for synthesizing sound during steady state conditions associated with stop and go driving, according to one or more embodiments.

With reference to FIG. 9, a method for synthesizing sound during steady state conditions associated with repeated acceleration and deceleration during stop and go traffic is illustrated according to one or more embodiments, and generally referenced by numeral 900. Generally, the method adds a time dependency to the SEN generation algorithm to gradually reduce the SEN during steady state stop and go conditions.

At step 910, the controller 116 receives input that is indicative of accelerator pedal position (ACC), and brake pedal position (BRAKE). Then at steps 912, the controller 116 evaluates the input to determine if a stop and go event has occurred. In one or more embodiments, a stop and go event occurs when: the driver applies the brake pedal beyond a predetermined brake pedal travel position (b); then applies the accelerator pedal beyond a predetermined accelerator pedal travel position (a); and then applies the brake pedal again beyond b. In one or more embodiments, a and b are equal to a predetermined percentage of pedal travel, e.g., 50%. If the stop and go conditions are met, i.e., 1) BRAKE>b; then 2) ACC>a; and then 3) BRAKE>b; the controller 116 proceeds to step 914 and increments a counter. In other embodiments, the controller 116 receives additional and/or alternate inputs at step 910.

At step 916, the controller 116 evaluates the time lapse or "GAP" between the current stop and go event and a previous stop and go event. If GAP is not greater than a predetermined time (t), the controller 116 proceeds to step 918 to evaluate the current setting of the counter (COUNT) as compared to a count threshold (THRESHOLD). In one or more embodiments, the predetermined time (t) may be equal to two minutes, and THRESHOLD may be equal to two. If the controller 116 determines that COUNT is greater than a predetermined count threshold (COUNT>THRESHOLD), the controller 116 determines that a steady state stop and go conditions are met, and proceeds to step 920.

At step 920, the controller 116 evaluates the current gain setting (GAIN) of the Additional Gain Block (AGB) 140 to determine if GAIN is currently set to a maximum target value (TARGET). The TARGET corresponds to a maximum reduction of the SEN in decibels (dB). In one or more embodiments, TARGET may be equal to −6 dB, which means that the method will reduce the SEN up to 6 dB below an expected engine noise during similar driving conditions. If GAIN is equal to TARGET, the controller 116 returns to step 910. Otherwise, the controller proceeds to step 922 and decreases the GAIN at a predetermined reduction rate or rate of decrease (RATE 1). RATE 1 may be equal to value between −0.5 and −0.33 dB per second (i.e., 1 dB every 2-3 s), according to one or more embodiments. Other embodiments include different time durations (GAP) count thresholds (THRESHOLD), target values (TARGET), and reduction rates (RATE 1).

Figure 10:
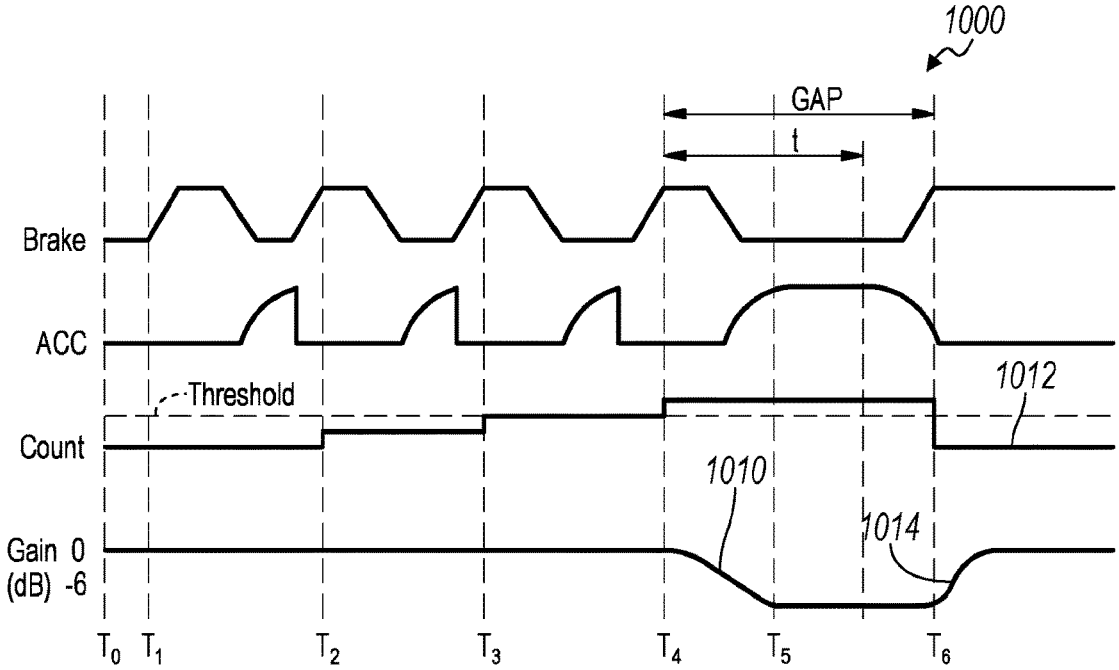
FIG. 10 is a graph illustrating how various parameters of the vehicle system of FIG. 1 change over time due to the method of FIG. 9.

FIG. 10 is a graph 1000 that illustrates an example of the impact of the method 900 for synthesizing sound during steady state stop and go conditions. The graph 1000 includes curves representing brake pedal position (BRAKE), accelerator pedal position (ACC), the current counter setting (COUNT), and the adjustable gain of the AGB 140 (GAIN).

At time T1, the driver applies the brake pedal (BRAKE). Between time T1 and T2, the driver releases the brake pedal (BRAKE), applies the accelerator pedal (ACC), then applies the brake pedal (BRAKE) again. At time T2, the controller 116 determines that a stop and go event has occurred, according to step 912, and then increments COUNT. Additional stop and go events are completed at time T3 and T4. At time T4, the controller 116 determines that COUNT exceeds a count THRESHOLD and starts reducing the GAIN at RATE 1, as depicted by reference numeral 1010. At time T5, the controller 116 determines that GAIN is equal to the TARGET of −6 dB, and then stops decreasing the GAIN, as described with reference to step 920.

Referring back to FIG. 9, in response to a negative determination at step 916, i.e., the controller 116 determines that the time lapse or "GAP" between the stop and go event and a previous stop and go event exceeds predetermined time (t), the controller 116 proceeds to step 924 and resets the counter setting (COUNT) to zero. When the steady state stop and go conditions are no longer met, i.e., a negative determination is made at step 912 or after a reset at step 924, the controller proceeds to step 926. At step 926, the controller 116 evaluates the current gain setting (GAIN) of the Additional Gain Block (AGB) 140 to determine if GAIN is currently set to a neutral value (NEUTRAL). The NEUTRAL value may be equal to 0 dB, which corresponds to no gain. If GAIN is not equal to MIN, the controller proceeds to step 928 and increases the RATE at a predetermined rate of increase (RATE 2). Once the controller 116 determines that GAIN is equal to MIN, i.e., a positive determination at step 928, the controller 116 returns to step 910.

With reference to FIG. 10, after time T6, the controller 116 determines that the elapsed time (GAP) since the last stop and go event has exceeded the predetermined time (t), i.e., a positive determination at step 916. Then the controller 116 resets the COUNT as depicted by numeral 1012; and increases the GAIN at RATE 2 as depicted by numeral 1014, which corresponds to steps 924 and 926.

The controller 116 uses the method 900 to detect the number of repeated acceleration and deceleration events from a certain minimum speed to a certain maximum speed during a certain time interval by monitoring accelerator pedal position and brake pedal position cycling. It is likely that the driver is not deriving driving enjoyment from this repeated stop and go events, so it is likely the desired system behavior is to reduce the SEN gain. The controller 116 gradually adjusts the GAIN, i.e., by a rate of decrease (RATE 1), and by a rate of increase (RATE 2). Typically, these adjustments occur at different rates, i.e. the rate of decrease should mostly occur in a subtle and gradual way, but the rate of increase often needs to occur quickly, as a state change will soon occur.

Although in the embodiments described above, the gain of the SEN is adjusted in a specific gain adjusting block (i.e., AGB 140), it is understood that the gain of the SEN may be adjusted in other blocks. Further, other alternate digital or analog signal processing methods may be employed to adjust the level of the SEN. For example, high or low frequency shelves may be employed, as can various analog, FIR or IIR filters that may remove energy from particular frequency bands of the SEN to reduce its perceived level in the vehicle. Any or combinations of any of the aforementioned methods, or other methods known to those skilled in the art, may be employed to reduce the sound pressure level, loudness or perceived loudness of the SEN.

In embodiments above and in FIG. 2, multiple methods of SEN synthesis are described. Alternate methods and alternate methods using alternate signal processing blocks are possible to implement. The disclosed methods of reducing the level of the SEN when steady state conditions are detected may be employed with these alternate methods.

While exemplary embodiments are described above, it is not intended that these embodiments describe all possible forms. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. A vehicle sound synthesis system comprising:

a controller programmed to:

receive an input indicative of at least one of a gear selection, an engine speed, and a pedal position;

generate an audio signal indicative of synthesized engine noise (SEN);

attenuate the audio signal at a first rate in response to at least one of the gear selection, the engine speed, and the pedal position indicating first vehicle conditions;

wherein the first vehicle conditions comprise steady state engine idle conditions, and wherein the controller is further programmed to attenuate the audio signal in response to:

a) the gear selection indicating that the vehicle is in drive, b) the pedal position indicating at least one of a release of an accelerator pedal and an applied brake pedal, and c) the engine speed being within a threshold range for a period of time that exceeds a predetermined time; and a loudspeaker adapted to project sound within a passenger compartment of a vehicle in response to receiving the attenuated audio signal.

2. The vehicle sound synthesis system of claim 1, wherein the controller is further programmed to attenuate the audio signal by decreasing a gain of the audio signal to a predetermined target value.

3. The vehicle sound synthesis system of claim 2, wherein the predetermined target value is between −6 and −10 dB, and wherein the first rate is between −0.5 and −0.33 dB/s.

4. The vehicle sound synthesis system of claim 1, further comprising at least one microphone adapted to provide a microphone signal indicative of the sound projected by the loudspeaker and noise within the passenger compartment, and wherein the controller is further programmed to:

generate a cancel signal to reduce engine characteristics based on the microphone signal and the engine speed;

combine the cancel signal with the attenuated audio signal; and provide the combined signal to the loudspeaker.

5. The vehicle sound synthesis system of claim 1, wherein the controller is further programmed to restore the audio signal at a second rate in response to at least one of the gear selection, the engine speed, and the pedal position indicating second vehicle conditions.

6. The vehicle sound synthesis system of claim 5, wherein the second rate is greater than the first rate.

7. The vehicle sound synthesis system of claim 1, wherein the controller is further programmed to attenuate the audio signal in response to:

a) the gear selection indicating that the vehicle is in at least one of drive and park; and b) the engine speed being within a threshold range for a period of time that exceeds a predetermined time.

8. The vehicle sound synthesis system of claim 7, wherein the threshold range is based on a percentage of a predetermined engine speed.

9. The vehicle sound synthesis system of claim 7, wherein the threshold range is based on a percentage of a rolling average of the engine speed.

10. The vehicle sound synthesis system of claim 1, wherein the controller is further programmed to attenuate the audio signal in response to the gear selection indicating that the vehicle is in reverse for a period of time that exceeds a predetermined time.

11. The vehicle sound synthesis system of claim 1, wherein the controller is further programmed to attenuate the audio signal in response to the pedal position indicating:

a) a first applied brake pedal;

b) an applied accelerator pedal; and c) a second applied brake pedal.

12. An audio system comprising:

the vehicle sound synthesis system according to claim 1; and a head unit programmed to provide a music audio signal;

wherein the controller is further programmed to combine the audio indicative of SEN and the music audio signal, generate a combined audio signal, and provide the combined audio signal to the loudspeaker.

13. A vehicle system comprising:

a controller configured to:

generate an audio signal indicative of synthesized engine noise (SEN);

attenuate the audio signal at a first rate in response to at least one of a gear selection, an engine speed, and a pedal position indicating first vehicle conditions;

wherein the first vehicle conditions comprise reverse travel conditions, and wherein the controller is further programmed to attenuate the audio signal in response to the gear selection indicating that the vehicle is in reverse for a period of time that exceeds a predetermined time; and provide the attenuated audio signal to a loudspeaker mounted within a vehicle passenger compartment.

14. The vehicle system of claim 13, wherein the controller is further configured to attenuate the audio signal in response to:

a) the gear selection indicating at least one of drive and park; and b) the engine speed being within a threshold range for greater than a predetermined time, wherein the threshold range is based on a percentage of a running average of the engine speed.

15. The vehicle system of claim 13, wherein the controller is further configured to restore the audio signal at a second rate in response to at least one of the gear selection, the engine speed, and the pedal position indicating second vehicle conditions.

16. The vehicle system of claim 13 further comprising at least one microphone adapted to provide a microphone signal indicative of a sound projected by the loudspeaker and noise within the passenger compartment, and wherein the controller is further programmed to:

generate a cancel signal to reduce engine characteristics based on the microphone signal and the engine speed;

combine the cancel signal with the attenuated audio signal; and provide the combined signal to the loudspeaker.

17. An audio system comprising:

the vehicle system according to claim 13; and a head unit programmed to provide a music audio signal; and wherein the controller is further programmed to combine the audio indicative of SEN and the music audio signal, generate a combined audio signal, and provide the combined audio signal to the loudspeaker.

18. A method for synthesizing engine noise (SEN) comprising:

receiving input indicative of at least one of gear selection, engine speed, and pedal position;

generating an audio signal indicative of SEN;

attenuating the audio signal at a first rate in response to the pedal position indicating:

a) a first applied brake pedal, b) an applied accelerator pedal, and c) a second applied brake pedal; and providing the attenuated audio signal to a loudspeaker mounted within a vehicle passenger compartment.

19. The method of claim 18, further comprising restoring the audio signal at a second rate in response to the input indicating second vehicle conditions.

20. The method of claim 18, further comprising attenuating the audio signal in response to:

a) the gear selection indicating at least one of drive and park; and b) the engine speed being within a threshold range for greater than a predetermined time.

* * * * *